US007988435B2

(12) United States Patent
Fujimoto et al.

(10) Patent No.: US 7,988,435 B2
(45) Date of Patent: Aug. 2, 2011

(54) OILLESS SCREW COMPRESSOR AND COMPRESSED AIR COOLING UNIT

(75) Inventors: Hideki Fujimoto, Shizuoka (JP); Hitoshi Nishimura, Shizuoka (JP); Natsuki Kawabata, Shizuoka (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 814 days.

(21) Appl. No.: 11/752,319

(22) Filed: May 23, 2007

(65) Prior Publication Data

US 2008/0166253 A1 Jul. 10, 2008

(30) Foreign Application Priority Data

Jan. 5, 2007 (JP) ..... 2007-000304

(51) Int. Cl.
*F01C 21/04* (2006.01)
*F03C 2/00* (2006.01)

(52) U.S. Cl. ..... 418/83; 418/9; 418/85; 418/201.1; 417/243; 417/410.4

(58) Field of Classification Search ..... 418/9, 83, 418/201.1, 206.1, 85, 86; 417/243, 244, 417/313, 363, 410.3, 410.4
See application file for complete search history.

(56) References Cited

FOREIGN PATENT DOCUMENTS

| | | |
|---|---|---|
| EP | 1 138 948 A2 | 10/2001 |
| JP | 03-290089 | 12/1991 |
| JP | 11-019461 | 1/1999 |
| JP | 11-336684 | 12/1999 |
| JP | 2001-153080 | 6/2001 |
| JP | 2006-249934 | 9/2006 |

OTHER PUBLICATIONS

Office Action of Chinese Appln. No. 200710104469 dated Jul. 31, 2009 with partial translation.
European Search Report dated Jan. 25, 2001; National Registration No. BE 200700243; 6 pages; European Patent Office.

*Primary Examiner* — Theresa Trieu
(74) *Attorney, Agent, or Firm* — Antonelli, Terry, Stout & Kraus, LLP.

(57) ABSTRACT

An oilless screw compressor incorporating water-cooled cooling units for cooling compressed air discharged from compressor bodies having a pair of male and female screw rotors which can be rotated in a contactless and oilless manner, the cooling units comprising a plate type heat-exchanger, and the amount of cooling water for the plate type heat-exchanger being adjustable. With this configuration, a difference between a temperature during load operation and a temperature upon automatic stopping and during unload operation of the compressor can be reduced, so that the cooling unit can be restrained from being damaged or broken within a short period, thereby it is possible to provide a highly reliable oilless screw compressor.

19 Claims, 3 Drawing Sheets

OILLESS SCREW COMPRESSOR AND COMPRESSED AIR COOLING UNIT

INCORPORATION BY REFERENCE

The present application claims priority from Japanese application JP2007-000304 filed on Jan. 5, 2007, the content of which is hereby incorporated by reference into this application.

BACKGROUND OF THE INVENTION

The present invention relates to an oilless screw compressor incorporating a heat-exchange for cooling compressed air.

There has been known an oil-free compressor having a pair of male and female screw rotors which can be rotated by timing gears in a contactless and oilless manner so as to compress air. The oil-free compressor has a compressor body for compressing air, and since the temperature of the compressed air discharged from the compressor body becomes high, the compressor is incorporated with a cooling unit for cooling the compressed air.

JP-A-3-290089 discloses a single stage oil-free compressor having such a configuration that a pre-cooler or an aftercooler is incorporated as the cooling unit for cooling the compressed air. In this example, an external cooling water is fed through the cooling unit in order to aim at cooling the compressed air.

JP-A-2001-153080 discloses a two-stage compressor having two compressor bodies. In this compressor, the compressed air from the first stage compressor body is cooled by an intercooler and the compressed air from the second stage compressor body is cooled by an aftercooler, respectively, as cooling units, which are fed thereinto cooling water. Further, JP-A-2006-249934 discloses a two-stage compressor in which the compressed air is cooled by a plate-type heat-exchanger.

In a screw compressor, a power required for compressing air is converted into heat, and accordingly, the temperature of the compressed air rises. The temperature of the compressed air becomes extremely high. As to the oilless screw compressor (oil-free compressor), the temperature of the compressed air discharged from the compressor body comes up to a temperature in a range from about 300 to 350 deg. C. in the case of the single stage type compressor, and in a range from 160 to 250 deg. C. even in the case of the two-stage type compressor.

There have been frequently used, as the cooling unit for cooling the high temperature compressed air in a water cooled compressor, a shell-and-tube type water cooled heat-exchanger (as, for example, disclosed in JP-A-2001-153080) in both single-stage and two-stage type. In the case of the two-stage type compressor, there are arranged individually a heat-exchanger for cooling a low pressure stage compressed air and a heat-exchanger for cooling a high pressure stage compressed air.

It has been difficult to miniaturize the shell-and-tube type water cooled heat-exchanger in view its structure, that is, it has been difficult to greatly miniaturize not only the cooling unit itself in the oilless screw compressor but also the oilless screw compressor unit. JP-A-3-290089 discloses an example utilizing a tube-type heat-exchanger, which is also difficult to be miniaturized, that is, it has been such a configuration that the miniaturization thereof is difficult.

Thus, it has been proposed to use the plate type heat-exchanger, which has a volumetric ratio of about 1/10 to 1/20 in comparison with the shell-and-tube type heat-exchanger, that is, the miniaturization thereof is extremely simple.

However, in the case of using the plate type heat-exchanger for cooling the high temperature compressed air discharged from the compressor body of the oilless screw type compressor, its fitting ports, channel plates, brazed portions between the channel plates and cover plates would be damaged or broken due to thermal fatigue caused by temperature difference. In particular, in a compressor which can be driven in response to the users' demand, upon automatic stopping of the compressor or unload operation (no-load running) thereof, only a slight quantity of compressed air remains in the heat-exchanger, that is, only the cooling water flows through the plate-type heat-exchanger, resulting in high possibility of occurrence of a temperature difference. At this time, since the cooling unit would be damaged or broken within a short time, there has been caused lowering of the reliability of the compressor itself.

SUMMARY OF THE INVENTION

In view of the above-mentioned problems, the present invention aims at providing a highly reliable oilless screw compressor in which damage and breakage of a cooling unit is restrained.

To the end, according to a first aspect of the present invention, there is provided an oilless screw type compressor comprising a water-cooled cooling unit for cooling compressed air discharged from a compressor body having a pair of female and male screw rotors which can be rotated in a contactless and oilless manner, wherein the cooling unit is composed of a plate type heat-exchanger, and a amount of cooling water for the plate type heat-exchanger can be adjusted.

Further, according to a second aspect of the present invention, there is provided an oilless screw compressor comprising a low pressure stage compressor body having a pair of male and female screw rotors which can be rotated in a contactless and oilless manner, for compressing air sucked thereinto, a water cooled type first heat-exchanger for cooling the compressed air discharged from the low pressure stage compressor body, a high pressure stage compressor body for compressing the compressed air cooled by the first heat-exchanger, and a water-cooled second heat-exchanger for cooling the compressed air discharged from the high pressure stage compressor body, wherein the fist and second heat-exchangers are composed of a plate type heat-exchanger, and an amount of cooling water for the plate type heat-exchanger can be adjusted.

Further, in the above-mentioned aspects of the present invention, there may be provided more preferable specific embodiments as follows:

(1) the amount of the cooling water is adjusted or the supply of the cooling water is stopped upon automatic stopping of the compressor:

(2) the amount of the cooling water is adjusted or the supply of the cooling water is stopped in accordance with a time of no-load operation during no-load operation;

(3) the amount of the cooling water is adjusted or the supply of the cooling water is stopped, depending upon a temperature of the compressed air at an inlet port or an outlet port of the plate type heat-exchanger, or a temperature of the cooling water at the outlet port of the plate type heat-exchanger;

(4) the oilless screw compressor in which the plate type heat-exchanger has a compressed air fitting port and a cooling water fitting port which are arranged on opposite sides, respectively;

(5) the cooling water for the plate type heat-exchanger is fed thereinto after it cools the low pressure stage compressor body, the high pressure stage compressor body, or both of them; and (6) the cooling water for the plate type heat-exchanger is fed thereinto after it is fed into a lubricant heat-exchanger.

Further, in the second aspect of the present invention, it is preferable that the cooling water for the plate type heat-exchanger is fed into the plate type heat-exchanger for cooling the compressed air discharged from the high pressure stage compressor body after it is fed into the plate type heat-exchanger for cooling the compressed air discharged from the low pressure stage compressor body. Alternatively, it is preferable that the cooling water is fed into the plate type heat-exchanger for cooling the compressed air discharged from the low pressure stage compressor body after it is fed into the heat-exchanger for cooling the compressed air discharged from the high pressure stage compressor body.

In addition, in the first or second aspect of the present invention, there is preferably provided such a configuration that the above-mentioned plate type heat-exchanger is provided in the compressor body, a gear casing incorporating gears for driving the compressor body, a pipe line through which the high temperature compressed air flows, or at a position where waste heat therefrom is received, or such a configuration that the plate type heat-exchanger is integrally incorporated with the compressor body, the gear casing or the pipe line.

According to the present invention, there can be provided a highly reliable oilless screw compressor.

Other objects, features and advantages of the invention will become apparent from the following description of the embodiments of the invention taken in conjunction with the accompanying drawings.

DETAILED DESCRIPTION OF THE PREFERRED EMBODIMENTS

Figure 1:
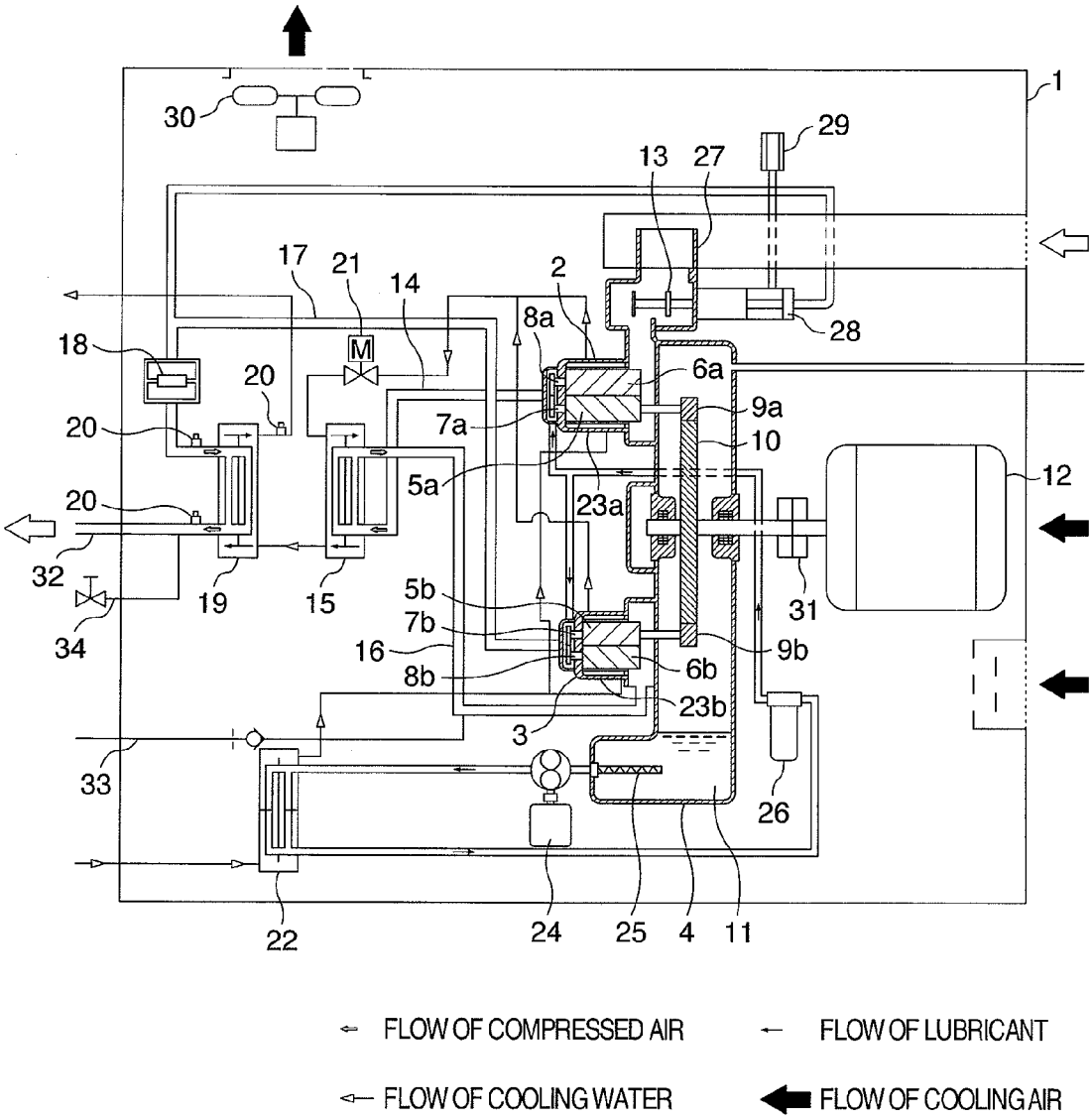
FIG. 1 is a system diagram illustrating an entire configuration of a water cooled two-stage oilless screw compressor according to the present invention.

Explanation will be hereinbelow made of an oilless screw compressor comprising a compressor body having a pair of male and female screw rotors which can be rotated by timing gears in a contactless and oilless manner, and a cooling unit for cooling compressed air discharged from the compressor body, wherein the cooling unit for the compressed air is composed of a plate type heat-exchanger, as an embodiment according to the invention.

In particular, explanation will be made of such an example that thermal fatigue of the plate type heat-exchanger is reduced by restraining variation in temperature of the plate type heat-exchanger, caused during automatic stopping or unload operation of the compressor, thereby it is possible to avoid occurrence of damage or breakage of the plate type heat-exchanger.

Specifically, there has been provided a means for stopping the supply of cooling water for the plate type heat-exchanger, or a means for adjusting an amount of the same, during an automatic stopping or unload operation of the compressor. The means for adjusting the amount of cooling water is capable of stopping the supply of the cooling water for the plate type heat-exchanger or adjusting the amount of the same during stopping of the compressor, depending upon information concerning any one of an unload time, a cooling water temperature or a temperature of the compressed air, by means of a selector valve or an adjusting valve connected to a cooling water pipe line.

A typical one of portions which could be damaged or broken due to thermal fatigue, in the plate type heat-exchanger, is fitting ports subjected to large temperature variation. Each fitting port is provided in a cover plate covering the associated plate. It is preferable that the fitting port for the compressed air and the fitting port for the cooling water are not provided in one and the same cover plate but are arranged being opposed to each other.

In order to reduce temperature variation of the plate type heat-exchanger during unload operation, the cooling water can be fed into the plate type heat-exchanger after the supply of the cooling water into the lubricant heat-exchanger, and alternately in the case of using the cooling water for cooling the compressor body, the cooling water is fed thereinto after the supply of the cooling water into a cooling jacket of the compressor body, or after the supply of the same into both of them.

Further, the plate type heat-exchanger should restrain variation in the temperature thereof during automatic stopping or unload operation of the compressor, and accordingly, the following configuration should be used: that is, the plate type heat-exchanger is arranged in the vicinity of the compressor body, the gear casing incorporating therein gears for driving the compressor, in which extra heat remains due to waste heat in the compressor unit, and a pipe line through which the high temperature compressed air flows, or the plate type heat-exchanger is integrally incorporated therewith. Explanation will be hereinbelow made of a specific embodiment with reference to the drawings.

FIG. 1 is a system diagram which shows an entire configuration of a water cooled two-stage oilless screw compressor in this embodiment. The water cooled two-stage screw compressor 1 comprises a low pressure stage compressor body 2 and a high pressure stage compressor body 3, which are coupled with a gear casing 4. Each of the low pressure stage compressor body 2 and the high pressure stage compressor body 3 is incorporated therein with a pair of screw rotors, these are a male rotor 5 and a female rotor 6. These rotors are attached at their axial one end with timing gears 7, 8.

The male rotor 5 is attached at its one axial end with a pinion gear 9, which is meshed with a bull gear 10 attached to a shaft of a motor 12. The pinion gear 9 and the bull gear 10 are accommodated in the gear casing 4 having a lower part serving as an oil reservoir 11. Further, the end part of the shaft attached thereto with the bull gear 10 is coupled to the shaft of the motor 12 through the intermediary of a coupling 31. With the use of these compressor driving gears, the output power of the motor 12 is transmitted to the compressor body.

It is noted that some of reference numerals in FIG. 1 are followed by "a" and "b", which indicate those members belong to the low pressure stage compressor body 2 and the high pressure stage compressor body 3, respectively.

The low pressure stage compressor body 2 is connected on the suction air side (in the upper part) thereof with a suction throttle valve 13 for adjusting the amount of air sucked into the screw compressor body. Thus, by adjusting the throttle valve 13, the amount of air to be compressed can be adjusted.

Further, an air passage is formed by a pipe line, so that air taken into the screw compressor 1 is compressed and is then discharged. That is, the air fed from the suction port into the low pressure stage compressor body 2 by way of the suction throttle valve 13 is compressed through the rotation of the pair of rotors, and is then fed into a discharge pipe line 14 on the compressed air discharge side. Thereafter, the air is fed into the high pressure stage compressor body 3 by way of a discharge pipe line 16 connected to the suction port of the high pressure stage compressor body 3. The air fed into the high pressure stage compressor body 3 is further compressed, and then is discharged from the discharge port into a discharge pipe line 17 on the compressed air discharge side, from which the compressed air is fed into a discharge pipe line 32 connected to an external supply side line (which is not shown) of the compressor unit 1.

The discharge pipe line 14 on the compressed air discharge side of the low pressure stage compressor body 2 is connected to a heat-exchanger 15 for the low pressure stage compressed air, which is composed of a plate type heat-exchanger, that is, the plate type heat-exchanger is used as the heat-exchanger 15 for the low pressure stage compressed air. Further, the discharge pipe line 16 on the secondary side of the heat-exchanger 15 is connected to the suction port of the high pressure stage compressor body 3. That is, the plate type heat-exchanger as a cooling unit is connected in the passage connecting between the low pressure stage compressor body 2 and the high pressure stage compressor body 3.

The discharge port of the high pressure stage compressor body 3 is connected to the heat-exchanger 19 for the high pressure stage compressed air, which is composed of a plate type heat-exchanger, through a check valve 18 by way of the discharge pipe line 17. Accordingly, a secondary discharge pipe line 32 of the plate type heat-exchanger 19 for the high pressure stage compressed air is connected to the external supply line (which is not shown) of the compressor unit 1. That is, the plate type heat-exchanger is incorporated in the passage between the high pressure stage compressor body 3 and a connection for an external equipment.

Meanwhile, the cooling water is fed from an external portion of the unit, after flowing through the lubricant heat-exchanger 22, the jackets 23 for the low pressure stage compressor body 2 and the high pressure stage compressor body 3, the plate type heat-exchanger 15 for the low pressure stage compressed air and the plate type heat-exchanger 19 for the high pressure stage compressed air, and is then discharged outside of the cooling unit 1. Thus, the heating parts and the compressed air are cooled by the cooling water.

It is noted that there are provided a drain pipe line 33 for the low pressure stage compressed air and a drain pipe line 34 for the high pressure stage compressed air, respectively in the pipe lines downstream of the heat-exchanger 15 and the heat-exchanger 19, for external drainage.

The lubricant which is reserved in the oil reservoir 11 in the lower part of the gear casing 4, is sucked up through a strainer 25 for removing unnecessary matters, when an oil pump 24 is operated. Thereafter, the lubricant passes through the lubricant heat-exchanger 22 and an oil filter 26 so as to lubricate the gears and bearings (which are not shown) in the compressor bodies, gears in the gear casing 4 and the like, and is thereafter returned into the oil reservoir 11 in the lower part of the gear casing 4. Through heat-exchange with the cooling water in the above-mentioned lubricant circulation passage, the lubricant is cooled and is then fed into the several parts. It is noted, as shown in FIG. 1, that a cooling fan 30 is provided for air ventilation in the unit, and accordingly, the ambient air is led into and is vented from the unit by the cooling fan 30.

In the water cooled two-stage oilless screw compressor 1 as stated above, the torque of the motor 12 is transmitted to the male rotor 5 through the intermediary of gears such as the bull gear 10 and the pinion gear 9, for driving the compressor. The torque transmitted to the male rotor 5 is transmitted to the female rotor 6 through the intermediary of the timing gears 7, 8, and accordingly, the male rotor 5 and the female rotor 5 are rotated, being made into not contact with each other so that the ambient air is sucked into the compressor body by way of the suction filter 27 and the suction throttle valve 13, and is compressed up to a predetermined pressure. This compressed air is cooled with the above-mentioned configuration, and is then fed into the supply side.

It is noted, in FIG. 1, that the flow of the compressed air, the flow of the lubricant, the flow of the cooling water and the flow of the cooling air by the cooling fan 30 are indicated by the arrows, respectively.

Figure 2:
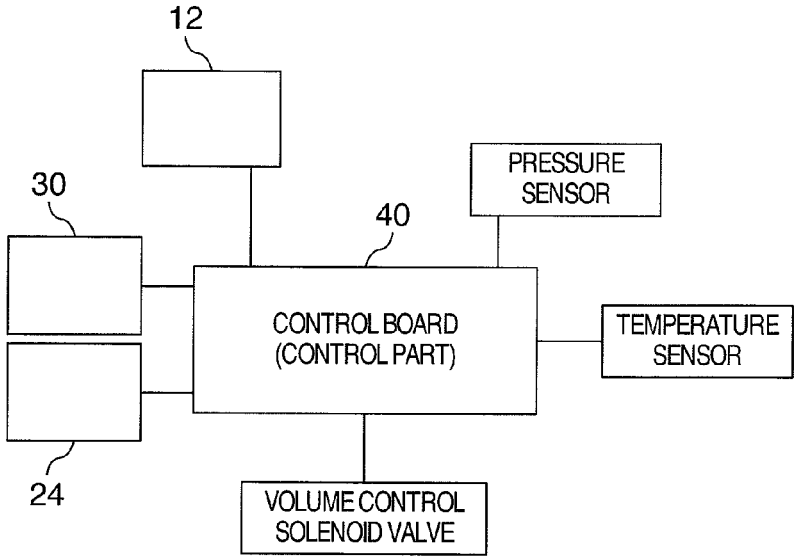
FIG. 2 is a control block diagram of an embodiment according to the invention.

Referring to FIG. 2 which is a control block diagram of the water cooled two-stage oilless screw compressor in this embodiment, in the water cooled oilless screw compressor 1 in this embodiment, the motor 12, the cooling fan 30 and the oil pump 24 are started so as to be driven by a control board (a control part) 40, and further, they are started when a capacitive solenoid valve is changed over so as to open a suction valve. When the motor 12 is operated, the low pressure stage compressor body 2 and the high pressure stage compressor body 3 are driven by the gear members as stated above, and accordingly, the air sucked thereinto is compressed.

Figure 3:
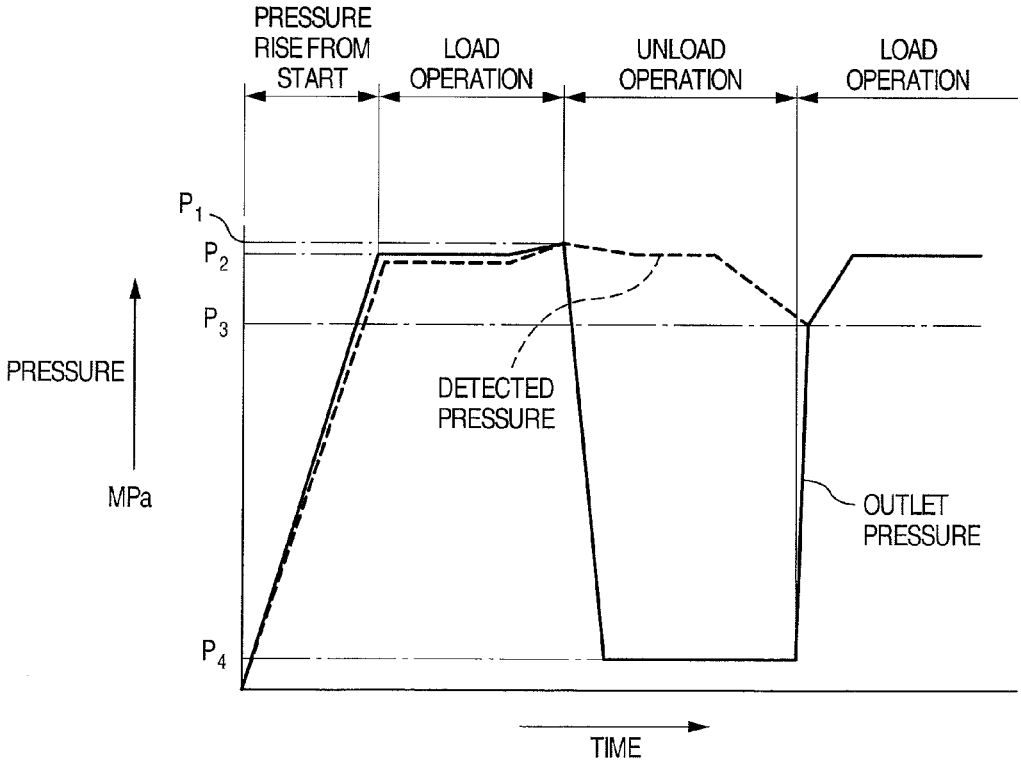
FIG. 3 is a view which shows pressure variation during operation.

Referring to FIG. 3 which shows variation in pressure during the operation, upon starting, the outlet pressure from the compressor 1 is increased. Thereafter, during load operation, the operation is continued at an output pressure $P_2$, and accordingly, high pressure air is fed to the client side equipment.

Upon load operation, in such a condition that the air is sufficient on the client side, the pressure in the discharge pipe line 32 increases. At this time, when the pressure which is detected by a pressure sensor (which is shown in FIG. 2) for detecting a pressure in the discharge pipe line, comes up to a pressure $P_1$ set as a value which is higher than the pressure $P_2$, it may be recognized as an overcharge condition, and accordingly, the capacitive solenoid valve is controlled so as to perform unload operation. Specifically, the control part 40 closes the suction throttle valve 13 but opens a vent valve 28 under control. During this unload operation, the output pressure becomes $P_4$ so that the motor 12 continues its rotation in an unload condition. It is noted that there may be used, as necessary, such an automatic stopping function that the motor 12 comes to a stop after the time of the unload operation elapses exceeding a predetermined time.

The air is used on the client side, and accordingly, when the detected pressure comes down to a pressure $P_3$ set as a value which is lower than the pressure $P_2$, the control part 40 again controls the capacitive control valves (such as the throttle valve 13, the vent valve 28 and the like) so as to carry out load operation with the output pressure $P_2$. Thus, depending upon the degree of consumption of the air on the client side, load/unload operation is repeated. That is, the control part 40 controls the capacitive control valves so as to constitute a load and unload cycle. As shown in FIG. 3, it goes without saying that the relationship $P_1>P_2>P_3>P_4$ is set.

Further, although detailed description will be omitted, the speed of the motor 12 may be changed in accordance with a value of consumption of the air in the case of incorporating an inverter unit.

Figure 4:
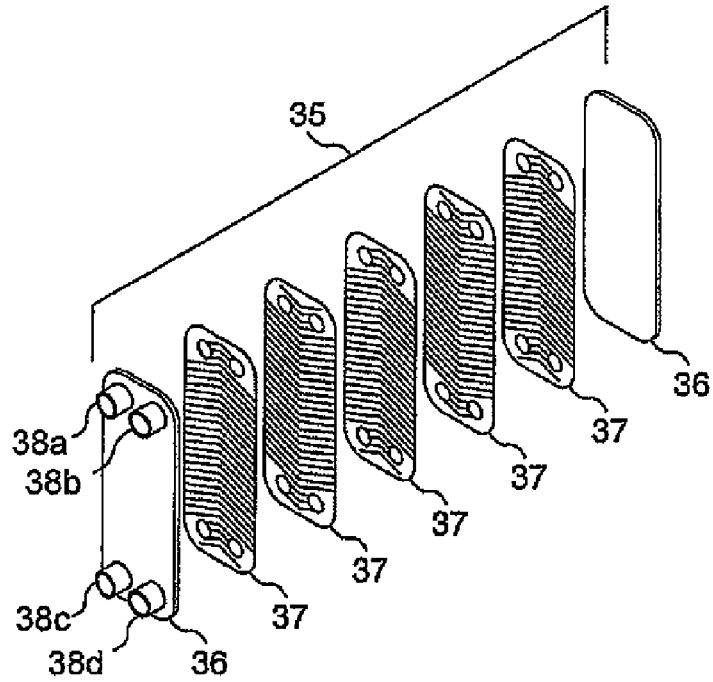
FIG. 4 is a structural view illustrating a plate type heat-exchanger used in a cooling unit.

Detailed explanation will be hereinbelow made of the cooling unit in this embodiment. FIG. 4 shows a structural view illustrating the plate type heat-exchanger used as the heat-exchanger for the compressed air.

The plate type heat-exchanger 35 used as the cooling unit in this embodiment, is composed of two cover plates 36 and channel plates 37 formed of an extremely thin stainless sheet. They are blazed with one another by copper or the like. Specifically, the channel plates 37 are interposed between the cover plates 36 surrounding the former at both sides. The compressed air and the cooling water are led into the pipe lines through the fitting ports 38. The compressed air and the cooling water are alternately led between the channel plates 37 so as to carry out the heat-exchange therebetween. Further, the channel plates 37 are formed therein with a herringbone pattern, that is, the channel plates 37 are formed therein with complicated passages which are alternately superposed with one another. With these complicated passages, the heat-exchange rate can be enhanced thereby it possible to miniaturize the heat-exchanger.

In the case of the oilless screw compressor, the compressed air having an extremely high temperature flows therethrough during load operation, and accordingly, it can be effectively cooled by the plate type heat-exchanger as the cooling unit. Meanwhile, during unload operation, the compressed air in the discharge pipe line between the check valve 18 and the compressor body is vented to the outside from a vent silencer 29 by the opening of the vent valve 28 so as to carry out unload operation. Upon automatic stopping or during unload operation of the compressor, the cooled air is returned to a check valve 18 from the supply side line.

Further, in this condition, if the cooling water is continuously fed into the plate type heat-exchanger, repeated stress is caused, due to temperatures with the frequent repetitions of such operation. The repeated stress due to the temperatures would cause damages or breakage to brazing parts between the channel plates 37, the channel plates 37, the cover plates 36 and the fitting ports 38 through which the high temperature compressed air passes at first due to differences in thermally expansion and contraction coefficients thereamong. Thus, it is difficult to use the plate type heat-exchanger under the above-mentioned repeated stress caused by high temperatures.

As an example, the temperature of compressed air discharged from the high pressure stage compressor body 3 of two-stage compressor of 75 kW type comes up to 200 deg. C. during load operation. However, the air which has been cooled down to a value nearly equal to the atmospheric temperature is returned from the supply side line to the check valve 18 upon automatic stopping or during unload operation of the compressor. Thus, should the cooling water continuously flow through the plate type heat-exchanger even upon automatic stopping or during unload operation of the compressor, the above-mentioned damage or breakage would be soon caused.

Accordingly, in accordance with the capacitive control, that is, the amount of the cooling water is controlled so as to be decreased during unload operation, the reliability of the heat-exchanger may be enhanced. For example, the temperature sensor 20 is incorporated so as to detect a temperature of the cooling water or a temperature of the compressed air. Further, the control part adjusts the amount of the cooling water in dependence upon the thus detected value, thereby it is possible to restrain the damage and the breakage of the plate type heat-exchanger.

More specifically, the amount of the cooling water flowing through the plate type heat-exchanger is adjusted in accordance with a temperature of the cooling water at the outlet port of the plate type heat-exchanger or a temperature of the primary or secondary side compressed air detected by the temperature sensor 20 (shown in FIG. 1). Thus, variation in the temperature of the plate type heat-exchanger is restrained upon automatic stopping or during unload operation of the compressor so as to reduce the repeated stress thermally caused. Thus, it is possible to provide such a configuration that damage or breakage of the plate type heat-exchanger can be avoided. The temperature sensor 20 may be provided so as to detect a temperature of the cooling water underneath the heat-exchanger 15 or the heat-exchanger 19, or to detect a temperature of the compressed air. It is permissible to provide temperature sensors at three positions as shown in FIG. 1.

Instead of the provision of the temperature sensors 20 as stated above, the amount of the cooling water may be controlled on the basis of a value detected by a pressure sensor. Because, unload operation is carried out if an external discharge pressure $P_1$ of discharging the water externally is detected by the pressure sensor so as to determine an overcharge condition, and accordingly, if the amount of the cooling water is reduced at this time, the similar effect can be obtained.

The adjustment for the amount of the cooling water is carried out by stepless control or on-off control with the use of a control equipment such as the electric valve 21 shown in FIG. 1, a solenoid valve or a temperature regulator valve. Further, the amount of the cooling water can be adjusted depending upon one or all of operating states of the compressor, such as a start or a stop of the compressor, a load or unload operation of the compressor and an operating time thereof.

As shown in FIG. 1, there is provided such a configuration that the cooling water is fed into the plate type heat-exchanger 15 for the low pressure stage compressed air and the plate type heat-exchanger 19 for the high pressure stage compressed air after flowing through the lubricant heat-exchanger 22 and the cooling jacket 23 for the compressor bodies upon automatic stopping or during unload operation of the compressor. There may be provided not only a single cooling water system but also a plurality of cooling water systems. By restraining variation in the temperature of the plate type heat-exchanger and by setting such a number of the cooling water systems and a flowing order of the cooling water for keeping the cooling capability, the operating frequency of a control equipment such as the electric valve 21, the solenoid valve or the temperature regulator valve can be restrained, thereby it is possible to also reduce the load exerted upon the control equipment.

Figure 5:
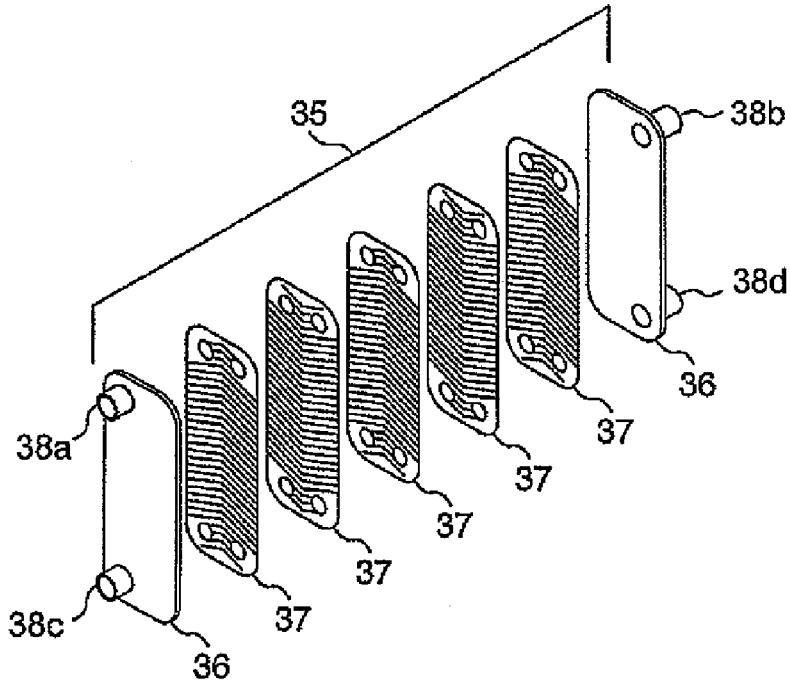
FIG. 5 is a structural view illustrating a plate type heat-exchanger used in a cooling unit.

Further, in the configuration of the plate type heat-exchanger, in stead of such a configuration, as shown in FIG. 4, that the fitting ports 38 for the compressed air and the cooling water are provided on one and the same cover plate 36, there may be more preferably used such a configuration that, as shown in FIG. 5, the fitting ports for the compressed air and the cooling water are provided in the different cover plates 36, respectively.

The fitting ports 38 are hereafter described. The amount of the cooling water is adjusted or the supply of the cooling water is stopped, depending upon a temperature of the compressed air at a compressed air inlet port 38*a* or a compressed air outlet port 38*c* of the plate type heat-exchanger, or a temperature of the cooling water at the cooling water outlet port 38*b* of the plate type heat-exchanger. Cooling water is supplied to the plate type heat exchanger through a cooling water inlet port 38*d*.

It is noted that the plate type heat-exchanger is set in a such a position that waster heat is highly possibly received, within the compressor unit. With this configuration, the plate type heat-exchanger can restrain from abruptly lowering its temperature upon automatic stopping and during unload operation of the compressor so as to reduce a burden upon the plate type heat-exchanger.

In view of the embodiments as stated above, in the oilless screw compressor in which the temperature of compressed air becomes high, a plate type heat-exchanger can be used. Further, in comparison with a conventional shell-and-tube heat-exchanger, the volume of the plate type heat-exchanger can be greatly reduced, and accordingly, it is possible to relax restraints to the layout of the heat-exchanger within the unit. Thus, the degree of freedom of laying out the pipe lines connecting between the heat-exchangers and the compressor bodies can be enhanced, and further, the length of the pipe line route can be shortened, thereby it is possible to aim at miniaturizing the overall size of the unit, and reducing the number of required components.

Thus, in the case of using a plate type heat-exchanger as a heat-exchanger for cooling a compressed air in an oilless screw type compressor in which the temperature of compressed air becomes higher, damage and breakage caused by the temperature fatigue can be avoided by adjusting the amount of the cooling air flowing through the plate type heat-exchanger. In addition to the adjustment for the amount of the cooling water, there may be used such a configuration that variation in the temperature of the plate type heat-exchanger can be restrained so as to restrain frequent operation of the cooling water switching valve or the regulator valve, thereby it is also possible to avoid damaging or breaking the control equipment.

It is noted that with the use of the inverter device so that the speed of the motor 12 is variable, the amount of the cooling water can be controlled in accordance with a speed of the motor 12.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. An oilless screw compressor comprising a water cooled cooling unit for cooling compressed air discharged from a compressor body having a pair of male and female screw rotors which are rotatable in a contactless and oilless manner, wherein the cooling unit is provided with a plate type heat-exchanger, and an amount of the cooling water in the plate type heat-exchanger is adjustable, and wherein the amount of cooling water is adjusted or a flow of cooling water is stopped, in accordance with a temperature of compressed air at an inlet or an outlet port of the plate type heat-exchanger or a temperature of the cooling water at an outlet port of the plate type heat-exchanger.

2. An oilless screw compressor as set forth in claim 1, wherein the amount of cooling water is adjusted, or the flow of the cooling water is stopped, upon automatic stopping of the compressor.

3. An oilless screw compressor as set forth in claim 1, wherein the amount of cooling water is adjusted or the flow of cooling water is stopped, in accordance with a time of unload operation during an unload operation.

4. An oilless screw compressor as set forth in claim 1, wherein the plate type heat-exchanger has a fitting port for the compressed air and a fitting port for the cooling water, and the fitting port for the cooling water and the fitting port for the compressed air are provided on opposite sides, respectively.

5. An oilless screw compressor as set forth in claim 1, wherein the cooling water is fed into the plate type heat-exchanger after cooling the compressor body.

6. An oilless screw compressor as set forth in claim 1, wherein the cooling water for the plate type heat-exchanger is fed thereinto after flowing through a lubricant heat-exchanger.

7. An oilless screw compressor as set forth in claim 1, wherein the plate type heat-exchanger is arranged in the compressor body, a gear casing in which gears for driving the compressor body are accommodated, a pipe line through which a high temperature compressed air flows, or at a position where waste heat therefrom is received.

8. An oilless screw compressor as set forth in claim 7, wherein the plate type heat-exchanger is integrally incorporated with the compressor body, the gear casing or the pipe line.

9. An oilless screw compressor comprising:

a low pressure stage compressor body having a pair of male and female screw rotors which are rotatable in a contactless and oilless manner, for compressing air sucked thereinto, a first water-cooled heat-exchanger for cooling compressed air discharged from the low pressure stage compressor body, a high pressure stage compressor body having a pair of male and female screw rotors which are rotatable in a contactless and oilless manner, for compressing the compressed air cooled by the first heat-exchanger, a second water-cooled heat-exchanger for cooling the compressed air discharged from the high pressure stage compressor body, wherein the first and second heat-exchangers are provided with plate type heat-exchangers, and amounts of cooling water in the plate type heat-exchangers are adjustable, and wherein the amounts of cooling water are adjusted or a flow of cooling water is stopped, in accordance with a temperature of compressed air at an inlet or an outlet port of the plate type heat-exchanger or a temperature of the cooling water at an outlet port of the plate type heat-exchanger.

10. An oilless screw compressor as set forth in claim 9, wherein the amounts of cooling water are adjusted, or the flow of the cooling water is stopped, upon automatic stopping of the compressor.

11. An oilless screw compressor as set forth in claim 9, wherein the amounts of cooling water are adjusted or the flow of cooling water is stopped, in accordance with a time of unload operation during an unload operation.

12. An oilless screw compressor as set forth in claim 9, wherein the plate type heat-exchangers have a fitting port for the compressed air and a fitting port for the cooling water, and the fitting port for the cooling water and the fitting port for the compressed air are provided on opposite sides, respectively.

13. An oilless screw compressor as set forth in claim 9, wherein the cooling water is fed into the plate type heat-exchangers after cooling the low pressure stage compressor body or the high pressure stage compressor body or both of them.

14. An oilless screw compressor as set forth in claim 9, wherein the cooling water for the plate type heat-exchangers is fed thereinto after flowing through a lubricant heat-exchanger.

15. An oilless screw compressor as set forth in claim 9, wherein the cooling water for the plate type heat-exchangers is fed into the plate type heat-exchanger for cooling the compressed air discharged from the high pressure stage compressor body after flowing through the plate type heat-exchanger for cooling the compressed air discharged from the low pressure stage compressor body.

16. An oilless screw compressor as set forth in claim 9, wherein the cooling water for the plate type heat-exchangers is fed into the plate type heat-exchanger for cooling the compressed air discharged from the low pressure stage compressor body after flowing through the plate type heat-exchanger for cooling the compressed air discharged from the high pressure stage compressor body.

17. An oilless screw compressor as set forth in claim 9, wherein the plate type heat-exchangers are arranged in the compressor body, a gear casing in which gears for driving the compressor bodies are accommodated, a pipe line through which a high temperature compressed air flows, or at a position where waste heat therefrom is received.

18. An oilless screw compressor as set forth in claim 17, wherein the plate type heat-exchangers are integrally incorporated with the compressor body, the gear casing or the pipe line.

19. An oilless screw compressor, comprising:

a water cooled cooling unit for cooling compressed air discharged from a compressor body having a pair of male and female screw rotors which are rotatable in a contactless and oilless manner;

a low pressure stage compressor body having the pair of male and female screw rotors, for compressing air sucked therefrom;

a first water-cooled heat-exchanger for cooling compressed air discharged from the low pressure stage compressor body;

a high pressure stage compressor body having the pair of male and female screw rotors and compressing the compressed air cooled in the first heat-exchanger; and a second water cooled heat-exchanger for cooling the compressed air discharged from the high pressure stage compressor body, wherein the first and second heat exchangers are provided with a plate type heat-exchanger, and an amount of the cooling water in the plate type heat-exchanger is adjusted, or the flow of the cooling water is stopped, upon automatic stopping of the compressor, in accordance with a time of unload operation during an unload operation, or in accordance with a temperature of compressed air at an inlet or an outlet port of the plate type heat-exchanger or a temperature of the cooling water at an outlet port of the plate type heat-exchanger.

* * * * *